US005507393A

United States Patent [19]

Yang

[11] Patent Number: 5,507,393

[45] Date of Patent: Apr. 16, 1996

[54] DEVICE AND PROCESS FOR GRAVITATIONAL SEPARATION OF SOLID PARTICLES

[76] Inventor: David C. Yang, 1219 Downwood Manor, Morgantown, W. Va. 26505

[21] Appl. No.: 306,033

[22] Filed: Sep. 14, 1994

[51] Int. Cl.[6] ..... B03B 5/66

[52] U.S. Cl. ..... 209/160; 209/173

[58] Field of Search ..... 209/172.5, 173, 209/273, 166, 168–170, 159, 160

[56] References Cited

U.S. PATENT DOCUMENTS

| | | | |
|---|---|---|---|
| 3,865,315 | 2/1975 | Roberts et al. | 209/173 X |
| 3,897,331 | 7/1975 | Smith et al. | 209/173 X |
| 4,111,798 | 9/1978 | Peterson et al. | 209/173 X |
| 4,592,834 | 6/1986 | Yang | 209/166 |
| 5,392,924 | 2/1995 | Hume | 209/173 X |

*Primary Examiner*—D. Glenn Dayoan

*Attorney, Agent, or Firm*—Spencer D. Conard

[57] ABSTRACT

A gravitational separation device is provided and the process is provided involving a packed column containing a packing material and having a device for vibrating the packed column and the particles. The gravitational separation device allows for efficient and effective separation of solid particles having different densities. The process preferably involves conditioning an aqueous pulp of mineral ore with a dispersant and feeding the dispersed aqueous pulp into an inlet into an intermediate section of the packed column and forming a high density bed of high density particles in a lower portion of the column, and forming a low density bed of low density particles in an upper portion of the column. Tailings are removed from the upper end of the column and concentrated mineral ore having reduced levels of gangue are removed from the bottom of the column. The device and process are especially useful in the separation of silica particles having small particle sizes from iron ore particles having small particle sizes.

20 Claims, 1 Drawing Sheet

Fig. 1
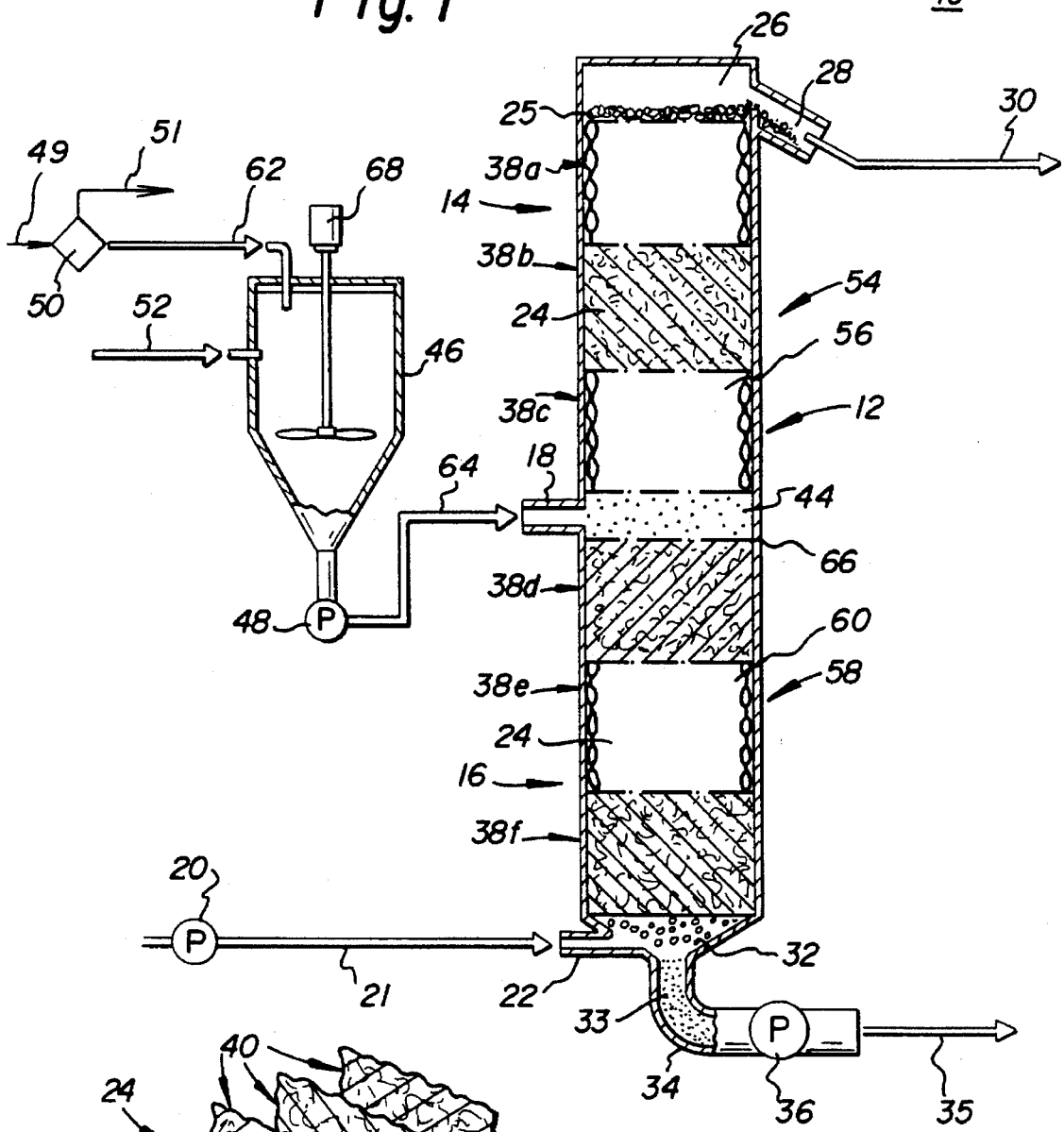
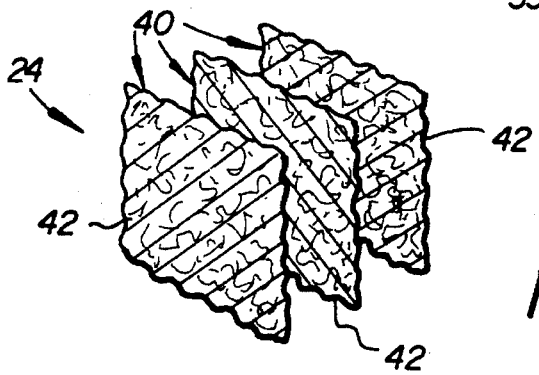
Fig. 2

DEVICE AND PROCESS FOR GRAVITATIONAL SEPARATION OF SOLID PARTICLES

BACKGROUND OF THE INVENTION

1. Field of the Invention

The present invention relates to gravitational separation of particles and more particularly relates to a device and a process for the gravitational separation of solid particles having density differences.

2.Description of the Related Art

Prior processes and devices for purification of solid particles, for example iron ore, include systems such as set out in Yang, U.S. Pat. 4,592,834, issued Jun. 3, 1986, which is incorporated herein by reference. Prior processes for mechanically separating silica ($SiO_2$) from iron ore (e.g., magnetic concentrate) at high processing rates have been unable either (1) to reduce silica levels from above 5.5 weight percent based on the total weight of the iron ore to below 5.0 weight percent based on the total weight of the iron ore or (2) to recover iron values in the product more than 95 percent based on the total weight of iron ore in the feed pulp. These problems associated with alleviating in combination (1) low (reduced) silica levels in the final product and (2) high (enhanced) iron recovery levels generally resulted from the inability (or inefficiency) of prior processes to separate out iron fines (particle sizes of smaller than 150 mesh size or 100 microns) from silica fines (smaller than 150 mesh size or 100 microns). Various crude iron ores contain agglomerates of iron rich material and silica rich material, and failure to adequately comminute (crush, powder, pulverize or grind) the iron ore results in inadequate separation of the iron material and the silica material. Consequently, in prior processes carrying a substantial amount of silica along with the iron thereby often resulted in undesirably high (greater than 5 percent by weight) silica impurities in the final iron product. Conversely, excessive comminuting (pulverizing, grinding, powdering, or crushing) can result in high levels of fines (particle sizes of smaller than 150 mesh) which cannot be effectively and efficiently separated via prior processes such as flotation processes or magnetic separation processes.

Traditionally, coal or mineral gravity separation is carried out in a variety of separation devices such as thickeners, cyclones, tables, jigs, spirals, and heavy media separators. These conventional methods depend on size, shape and densities of the particles to be separated as well as fluid dynamic conditions in the separators. The separation efficiency, however, deteriorates as the feed material becomes finer or if particle sizes vary greatly.

Heavy media separation for coal cleaning, for example, is only effective for treating particles coarser than 28 mesh. Even though flotation works on particles sizes less than 28 mesh, flotation cannot be used to reject pyrite particles which tend to coalesce with coal as a froth product due to their similar surface hydrophobicities. In addition, the results of conventional flotation techniques are relatively poor in comparison to density-based coal washability. Additionally, conventional jigging processes have typically experienced instabilities and vorticity in the dense particle media, resulting in undesirable vertical mixing in the media. Furthermore, small particle sizes typically result in undesirably high levels of short circuiting in jigging processes.

Consequently, there is a need for devices and processes which will in combination provide high purity (for example, low silica iron ore) product and will provide high product (for example, iron) recovery levels.

Summary of the Invention

The present invention provides a separation process and a device which effectively and efficiently reduce silica levels, or other gangue levels, while providing high recovery levels of the desired solid particles, preferably mineral values from ores. The process and device reduce instabilities and vorticity and thereby decreases vertical mixing. Additionally, the process and device reduce short circuiting and allow for effective and efficient separation of small particles by effectively creating small jigging cell sizes. The process involves gravitational separation of relatively high and low density particles which are initially in admixture in an aqueous pulp. The process preferably involves (a) providing a tubular column having an upper portion including a low density bed zone, a lower portion including a high density bed zone, and an intermediate portion including a pulp inlet zone preferably between the upper portion and lower portion; (b) providing in the upper zone and/or the lower zone a packing material defining a large number of flow passages extending in a circuitous pattern through the respective zones; (c) introducing the pulp into the pulp inlet zone for flow through the flow passages of the packing materials to form a low density bed of particles in the upper zone and a high density bed of particles in the lower zone; (d) jigging the beds to cause gravitational separation of the high and low density particles in the pulp by causing migration of the low density particles toward and into the low density bed and causing migration of the high density particles toward and into the high density bed; (e) withdrawing a tailing fraction containing low density particles from the upper portion of the column of the upper zone; and (f) withdrawing a concentrate fraction containing high density particles from the lower portion of the column below the lower zone. The device is particularly suitable for gravitational separation of the particles having differences in density wherein the particles are initially in an admixture of aqueous pulp, the admixture containing relatively low density particles and relatively high density particles. The device is preferably designed having: (a) a tubular column having an upper portion including a low density bed zone, a lower portion including a high density bed zone, and an intermediate portion including a pulp inlet zone preferably between the upper portion and lower portion, each of the beds containing a packing material defining a large number of small passages extending in a circuitous pattern through the respective zones; (b) means for forming a dispersion of aqueous pulp; (c) means for feeding the dispersion of aqueous pulp into the pulp inlet for flow into the column and through the flow passages; (d) means for jigging (vibrating) the aqueous pulp in the column to form a low density bed of low density particles in the low density bed zone and to form a high density bed of high density particles in the high density bed zone; (e) means for discharging a fraction containing low density particles of the aqueous pulp from the upper portion of the column above the low density bed zone; and (f) means for discharging a fraction containing high density particles of aqueous pulp from the lower portion of the column below the high density bed zone. Gravitational separation is achieved by vibration (preferably jigging) of the bed zones, and more specifically the low bed. Vibration can be achieved by water pulsation, air pulsation or by mechanical vibration, although water pulsation is the preferred means for generating vibration in the beds of the packed column. Although not critical, it is preferred for the present invention to utilize in combination the column having reduced cell sizes, the high density bed zone, and the vibration for gravity separation of the low density particles from the high density particles.

BRIEF DESCRIPTION OF THE DRAWINGS

FIG. 1 is a schematic representation of a gravitational separation device according to the present invention;

FIG. 2 is an exploded, perspective view of a portion of the corrugated plates making up one section of the packing for the column.

DETAILED DESCRIPTION OF THE INVENTION

Suitable aqueous pulps containing admixtures of particles of relative low density and high density, include mineral ores, coal or other particulate materials, preferably iron ores containing silica impurities, and more preferably involve a magnetic concentrate of a taconite iron ore containing greater than 60 percent by weight iron based on the total weight of the particles, and greater than 5 weight percent $SiO_2$ (silica) based on the total weight of the particles. The final concentrate product, preferably iron concentrate product, contains less than 5 weight percent of the gangue material, more preferably less than 4.5 percent silica, and most preferably less than 4.0 percent by weight silica. The low level of gangue material, silica material, in the final concentrate product allows for reduction of the lime required for blast furnace processing of the final iron ore product, and will result in the reduced slag formation in the blast furnace by the end user. Potentially the reduced levels of silica could result in the ability to bypass the blast furnace entirely because the silica levels achieved by the present process can be reduced to the 2 percent or lower level depending on the liberation characteristics of the feed material.

The gravitational separation device and process of the invention can be used to separate a wide variety of materials in a broad range of particle sizes. It is particularly adaptable for separation of mineral values from the gangue in fine-grained ores, such as low-grade, magnetic taconite ores from the Lake Superior area.

The density separation process may also be used for upgrading other oxidized or partially oxidized iron ores, cleaning coal to remove mineral matter (especially pyrite), or for recovery of other heavy minerals such as rutile, ilmenite, cassiterite, from finely ground ores and/or rejects. The invention will be described in connection with the purification of iron ore and coal.

The gravitational separation device (10) provided by the invention includes a tubular column (12) having an upper portion (14) and a lower portion (16), a pulp inlet (18) for introducing an aqueous slurry or pulp of a magnetic taconite ore into the column (12) at an intermediate location, and preferably pulsed water inlet (22) for introducing pulses of water into the lower portion (16) of the column (12).

The column (12) can be generally upright or vertical as illustrated in FIG. 1 or inclined at angle to the vertical. It is critical, however, that sufficient verticality is present to provide adequate gravitational forces to maintain the separate beds of high and low density particles as is described in more detail below. The column (12) is partially filled with means for reducing cell size and channeling such as a packing (24) which defines a large number of small flow passages and small chambers extending in a circuitous or tortuous pattern throughout the upper and lower portions (14 and 16).

A concentrate fraction (33) containing the high density particles in the aqueous pulp collects in a concentrate chamber (32) at the bottom of the column (12) and is discharged therefrom through an outlet (34). Although not particularly critical, the concentrate chamber (32) preferably is conically shaped as illustrated in FIG. 1 to promote discharge of the concentrate fraction. The concentrate fraction preferably is withdrawn through the outlet (34) by a conventional variable flow pump (36) as the final concentrate product (35).

While the column (12) can have various crosssectional configurations, in the specific construction illustrated, it has a square cross section. The cross sectional dimensions and length of the column (12) are governed by the type of aqueous pulp being treated, the particular type of packing (24) used, the desired throughput, and other variables familiar to those skilled in the art.

The packing (24) can be in a variety of different forms capable of providing a substantially plugged flow condition and defining a large number of flow passages and chambers extending in a circuitous or tortuous pattern within and between the upper and lower portions of the column (12). High density particles (iron rich particles) form a high density bed in the lower zone, and the low density particles (silica rich particles) form a low density bed in the upper zone. The packing facilitates maintenance and stabilization of the beds, and thereby facilitates separation of the beds. Vibration allows for movement of high density particles from the pulp feed into the high density bed, but effectively allows the high density bed to maintain an overall high density and compactness sufficient to permit it to resist penetration by the low density particles. Utilization of a dispersant resists agglomeration of the individual particles thereby allowing for continuous flow of the high density particles toward the bottom of the column and low density particles toward the top of the column. Suitable packing includes conventional packing materials used in packed tower for vapor-liquid transfer operations, such as Raschig rings, Berl saddles, partition rings, and the like. This packing may also include vertical, horizontal, and inclined plate structures with or without perforation. The packing functions as means for reducing cell size and channeling in the column.

In the preferred embodiment illustrated, the packing (24) involves a plurality of sections (**38*a*–38*f*) of vertical extending plates (40). Each section includes a plurality of the plates (40) and means for laterally spacing the plates (40) apart (spacer means) to define a plurality of relatively small flow passages between adjacent plates (40). In the specific construction illustrated, such spacer means comprises, but not limited to, uniformly spaced rows of corrugations (42) on each plate (40). The corrugations (42) preferably extend diagonally, e.g., at an angle of approximately 45° to the horizontal, to eliminate vertical flow passages of substantial length. The angular orientation of the corrugations (42) can be varied to control flow through the flow passage. For instance, this flow length can be increased by decreasing the angle of the corrugations (42**) to the horizontal.

In order to further enhance the circuitous or tortuous pattern of the flow passages defined between adjacent plates (40), the corrugations (42) of alternate plates (40) preferably extend in the opposite direction as illustrated in FIG. 2. That is, the corrugations on one plate extend at an angle to the corrugations on the next plate. Also, alternate sections are positioned so that the vertical planes of the plates in one section are angularly related (preferably at 90° ) to the vertical planes of the plates in the adjacent section. Referring to FIG. 1, the vertical planes of the plates (40) in sections (38*a*, 38*c*, and 38*e*) extend perpendicularly to the plane of the page and the vertical planes of the plates in sections (38*b*, 38*d* and 38*f*) extend parallel to the plane of the page.

The packing sections (38*c* and 38*d*) in the vicinity of the pulp inlet (18) preferably are spaced apart to provide a substantially unobstructed feed compartment or chamber (44). The packing sections (38*a*, 38*b*, and 38*c*) above the feed chamber (44) make up the upper zone of the column (12) and the packing sections (38*d*, 38e and 38*f*) below the feed chamber (44) make up a lower zone. The low density bed which is rich in gangue (silica) (for example more than 5 percent higher silica level than that of the feed material) will be present in the upper zone, and the high density bed which has reduced levels of gangue (silica) (for example, more than 0.5 weight percent less silica than that of the feed material).

In a typical operation, an iron ore, such as magnetic taconite or partially oxidized taconite, is comminuted into a particle size suitable for liberation of the mineral values, and preferably comminuted to a particle size of less than 100 microns, for example a mesh size of at least 150 mesh (mesh number values and particle size are inversely related i.e. the higher the mesh value the smaller the particle size). A means for removing larger size particles such as a screen having a mesh size of 150 (or finer) is preferably used to produce a feed pulp consisting of small particles (for example particles of less than 100 microns in diameter or less than 150 mesh in size). An aqueous slurry or pulp of the particles is introduced into a stirred treatment vessel (46) for the addition and admixing of suitable dispersant. Suitable dispersants for iron ore particles include, for example, sodium silicate. The most preferred dispersant is sodium silicate solution sold by PQ Corporation under the trademark "0" Brand or "N" Brand.

Following treatment, the pulp is withdrawn from the vessel (46) by a pump (48) and introduced into the column through the pulp inlet (18).

The flow rates of the various streams can be adjusted to obtain a material balance which provides the most effective separation of the high density particles (e.g., iron oxide) from the low density silica particles (e.g., gangue).

The device and process of the invention have several advantages over conventional devices and processes. They provide efficient and effective separation of very small particles having density differences, and in the case of iron ore containing silica (silicon dioxide) impurities by providing separative levels sufficient to reduce silica levels to below 5 percent in the final concentrate with high concentrate recoveries for example iron recovery in excess of 95 percent.

In addition to being used for single stage separation, the device of the invention can be used in combination with conventional separation steps and two or more can be used in series.

The upper sections (38*a*–38*c*) form an upper bed zone (54) in which a bed (56) of low density particles (silica rich particles) is present. The lower sections (38*d*–38*f*) form a lower bed zone (58) in which a bed (60) of high density particles (iron rich particles) is present. The feed chamber (44) is in the intermediate location preferably between the upper bed and the lower bed zones (54 & 58). An upper chamber (26) is located above the upper zone (54) and is in communication with an outlet (28) for removal and flow of low density particles (the tailings stream fraction (30)) from the column (12). The concentrate product stream (35) exits pump (36) and contains high density particles.

The comminuted ore stream (49) is prescreened by a screen mesh (50) of preferably 150 mesh size, or other suitable means for removing large particles from the stream, to produce an ore pulp stream (62) and a large particle stream (51) that can be either recirculated back to grinding or disposed of as waste. The ore pulp stream is fed into the treatment vessel (46) and is mixed with dispersants from dispersant stream (52) to produce a dispersed pulp stream (64).

A pulsed water pump (20), or other suitable means for vibration (jigging) the beds (56, 60) (more particularly the bed (60)) is used to gravitationally separate the particles while minimizing penetration of low density particles into the high density bed (60). Preferably the upper end of the bed (60) forms an upper compact surface (66) which resists penetration of the low density particles. At a steady state operation, the concentrate discharge from the high density bed (60) has a solids content of at least 95% by weight based on the total weight of particles in the feed stream (64), more preferably has a solids content of at least 98% by weight, and most preferably at least 99% by weight. The pulsed water preferably provides a pulse providing a change in water pressure of at least 0.05 psi, more preferably between 5 and 20 psi, most preferably between 10 and 15 psi. Preferably the pulse occur at frequencies of between 5 and 120 per minute, more preferably between 10 and 60 per minute, and most preferably between 15 and 30 per minute.

Another embodiment of this invention is concerned with the method of separating particulate material such as removal of mineral matter from coal, using a controlled density bed. This can be achieved either by the addition of a heavy medium, or by the application of fluid dynamic principles to use the heavier particles in situ, such as pyrite in coal, as the dense media. Initial laboratory testing shows that a clean coal of 8.8% ash at 52.8% yield can be produced from Alabama Pratt Seam raw coal feed (27.7% ash and 50%–22 μm) using a packed column on which pulsations are imposed with a reciprocating plunger; the fine fraction, i.e., –500 mesh, which contains large amounts of clay can be rejected either before or after the density separation. This indicates that the concept is applicable to a wide range of particle sizes and that efficient separation can be achieved by the present invention for various feed streams.

The present invention allows for eliminating the costly requirement of utilizing magnetite media in coal purification. Instead, coal pyrite (or the heavy mineral constituent in situ of the feed) may be utilized to control the specific gravity of the density bed.

The greater the number of cells the greater the degree of separation of the constituents. Separation may be equated to the number of cells that the material encounters in the separation process. An analogy may be made to theoretical plate calculations and equipment design employed by chemical engineers in absorber design as set out in Perry & Chilton, Chemical Engineer's Handbook, 5th Edition, Section 14, pages 10–13. The packing material of the present invention acts to effectively reduce channeling from the inlet to the outlet. Preferably the present columns have an effective height of at least 3 separation cells, more preferably between 10 and 100 separation cells in effectiveness. The packing enhances drag on the material as it moves which further enhances separation efficiency.

The present tubular column gravitational separation does not require flotation, magnetic or cyclone separation, and thus is preferably free of flotation agents, magnetic field generating separation equipments and cyclone generators. The system may use or be free of flocculents. The tubular column is preferably square in cross-section, and may optionally be rectangular or circular in cross-section. The column preferably has a height of from 6 inches to 20 feet.

The packing material preferably has a pore or chamber size diameter of between 5 and 100 times the number average diameter of the particles. The packing preferably provides chamber volume which is 125 to 1,000,000 times the number average particle size of the particles. Preferably the column has a base area of from 0.25 $m^2$ to 8,000 $m^2$, more preferably from 16 $m^2$ to 64 $m^2$. Preferably the packing is corrugated plate packing which is arranged in sections having a plurality of parallel plates, and each section is rotated (preferably 90° ) about a vertical axis relative to the adjacent section. Corrugated sheeting has an advantage of minimizing jamming (clogging) of ore in the column compared to other types of packing such as rings.

The flow rate of liquid through the column is sufficient to create a flow in the upper zone which exceeds the terminal velocity of the low density particles. Terminal velocity may be determined via Stokes' Law with the variables of particle-size diameter, density, and viscosity of the liquid. Control may be achieved via control of the feed rate or by utilization of an additional liquid inlet to maintain sufficient liquid flow in the upper zone.

Jigging frequency is preferably relative to particle size in a ratio of the inverse of the particle size, and is preferably a function of the inverse particle size. The bed densities may also be controlled to yield a desired grade by point measurement and control of feed rate and auxiliary water.

Typically gangue particles will typically have a density of between 2.6 and 2.7 g/$cm^3$ and the desired product particles will typically have a density of between 4 to 10 g/$cm^3$ for iron and other minerals. If coal is to be separated from clay then the gangue material will typically have a density of 2.6–2.7 g/$cm^3$ and the coal will typically have a density of from 1.2–1.6 g/$cm^3$. Particle differences are preferably at % density difference of at least 30%

The packing reduces channeling and break up vortices in the column.

EXAMPLES

The following examples illustrate the high recovery levels of low silica content iron ore achieved by the present device and process. A column 12 feet tall having a 3 inch I.D. circular cross section, included two 5-foot sections of packing plates. Each packing section was packed with 10 layers of corrugated plates, the plate corrugation were ½ inch high and extended at about 45° to the horizontal, and alternate layers or sections were oriented at 90° each to each other. A taconite magnetic concentrate from Mine A having a head (feed) assay of 66.42% Fe and 5.77% $SiO_2$ was ground to about 98%–150 mesh and was prescreened to remove particles larger than 150 mesh in size. The pulp was treated with a dispersant to minimize agglomeration of the particles during processing. The prescreened aqueous pulp feed containing about 20 weight percent solids was pumped into the intermediate feed zone of the column at a feed rate of about 120 lbs/hr. A pulse wash water introduced into the bottom of the column by alternatively applying and exhausting water pressure at about 10 lb/sq. inch from a pulsation chamber (this may vary in accordance with the total column height). The weight percent of concentrate product exceeded 90% of the original solids content of the feed pulp and resulted in an iron recovery in excess of 95% based on the total iron content of the aqueous pulp.

Examples 1A–1B
Magnetic Concentrate from Mine A
(98% –150 mesh)

| Product | % Wt | % Fe | % $SiO_2$ | % Fe Dist. |
|---|---|---|---|---|
| | Example 1A | | | |
| Conc. | 96.18 | 67.41 | 4.52 | 97.78 |
| Tail | 1.94 | 39.44 | 39.44 | 1.15 |
| +150 Mesh | 1.88 | 37.87 | 38.89 | 1.07 |
| Calc. Head | 100.00 | 66.31 | 5.71 | 100.00 |
| | Example 1B | | | |
| Conc. | 93.95 | 67.66 | 4.62 | 95.78 |
| Tail | 4.17 | 50.09 | 21.70 | 3.15 |
| +150 Mesh | 1.88 | 37.87 | 38.89 | 1.07 |
| Calc. Head | 100.00 | 66.37 | 5.97 | 100.00 |

Note that the small fraction of large particles initially screened out in the prescreen step (+150 mesh) had high silica levels. The prescreen in Examples 1A and 1B amounted to 1.88 weight percent of the initial pulp. Note the silica levels of less than 5 percent by weight in the concentrate products, and note the iron recovery levels in excess of 95%. This combination of low levels of silica in the final product and high iron recovery rates obtained by gravitational separation is both surprising and unexpected, and is especially unexpected in view of the small particle sizes utilized in the present process.

Examples 2A & 2B
Magnetic Taconite Crude from Mine A
(85% –325 mesh)

| Product | % Wt | % Fe | % $SiO_2$ | % Fe Dist. |
|---|---|---|---|---|
| | Example 2A (Crude = 100% wt) | | | |
| Conc. | 34.88 | 67.93 | 4.02 | 76.71 |
| Tail | 65.12 | 11.06 | 67.50 | 23.29 |
| Calc. Head | 100.00 | 30.89 | 45.36 | 100.00 |
| | Example 2B | | | |
| Conc. | 33.27 | 70.51 | 1.20 | 75.59 |
| Tail | 66.73 | 11.33 | 67.29 | 24.41 |
| Calc. Head | 100.00 | 31.03 | 45.30 | 100.00 |

Examples 3A & 3B
Magnetic Concentrate from Mine B
(80% –325 mesh)

| | Example 3A (magnetic concentrate = 100% wt) | | | | | |
|---|---|---|---|---|---|---|
| Product | % Wt | % Fe | % $SiO_2$ | % Fe Dist. | % Fe | *Plant Data % Fe Rec. |
| Conc. | 87.22 | 69.28 | 2.23 | 97.16 | 66.3 | 85.4 |
| Tail | 12.88 | 13.65 | 69.14 | 2.84 | | |
| Calc. Head | 100.00 | 62.18 | 10.85 | 100.00 | | |

-continued

Examples 3A & 3B
Magnetic Concentrate from Mine B
(80% −325 mesh)

| | Example 3B | | | |
|---|---|---|---|---|
| Product | % Wt | % Fe | % $SiO_2$ | % Fe Dist. |
| Conc. | 87.95 | 68.83 | 3.10 | 99.29 |
| Tail | 12.05 | 10.05 | 72.23 | 0.71 |
| Calc. Head | 100.00 | 61.75 | 11.43 | 100.00 |

*Plant flowsheet includes only one-stage reverse flotation. Note the improved results of the present process over the comparative plant data utilizing a conventional process.

Examples 4A & 4B
Magnetic Taconite Crude from Mine B
(80% −325 mesh)

| | Example 4A (Crude = 100% wt) | | | | | |
|---|---|---|---|---|---|---|
| Product | % Wt | % Fe | % $SiO_2$ | % Fe Dist. | % Fe | *Plant Data % Fe Rec. |
| Conc. | 33.29 | 69.88 | 1.82 | 68.40 | 66.3 | 58.5 |
| Tail | 66.81 | 16.09 | 66.85 | 31.60 | | |
| Calc. Head | 100.00 | 34.01 | 45.27 | 100.00 | | |

| | Example 4B | | | |
|---|---|---|---|---|
| Product | % Wt | % Fe | % $SiO_2$ | % Fe Dist. |
| Conc. | 36.52 | 67.57 | 4.38 | 70.95 |
| Tail | 63.48 | 15.91 | 67.19 | 29.05 |
| Calc. Head | 100.00 | 34.78 | 44.25 | 100.00 |

*Plant flowsheet comprises magnetic separation and reverse flotation. Note the improved results of the present process over the comparative plant data utilizing a conventional process.

process over the comparative plant data utilizing a conventional process.

EXAMPLE 5

Simplified Process for Cleaning Coal using the Density Bed Separator Coal feed was ground to fine particle sizes and a 150 mesh screen was utilized to prescreen large particles from the feed stream. The feed stream was then sent to a density bed separator pursuant to the present invention and the low density upper stream was then further screened by a 500 mesh screen and the oversize particles therefrom was the clean coal product and the undersize particles therefrom formed a clay slime which was disposed of. The high density stream constituted the tails and comprised mineral/pyrite. Results of the above test:

Test Results for Cleaning Alabama Pratt Seam Coal (27.7% ash) using the present separation process. Note the low 8.8% ash level of the product compared to the feed having a 27.7% ash level.

| Product | % Ash | % Yield | % CMR* |
|---|---|---|---|
| Clean Coal Product | 8.8 | 52.8 | 66.6 |
| −500 mesh Slimes | 40.4 | 33.6 | 27.7 |
| Bed Sinks | 69.3 | 13.6 | 5.7 |
| Combined Final | 48.7 | 47.2 | 33.4 |
| Tails | | | |
| Calc. Head | 27.7 | 100.0 | 100.0 |

*Combustible matter recovery

I claim:

1. A device for gravitational separation of particles having differences in density, said particles being initially in admixture in an aqueous pulp, said admixture comprising two or more types of particles ranging from relatively low density particles to relatively high density particles, said device comprising:

(a) a tubular column having an upper portion including a low density bed zone, a lower portion including a high density bed zone, and an intermediate portion including a pulp inlet zone between said upper portion and lower portion, each of said beds containing a packing material defining a large number of small passages and interconnected chambers extending in a circuitous pattern through the respective zones, (b) means for forming a dispersion of aqueous pulp, (c) means for feeding the dispersion of aqueous pulp into said pulp inlet zone for flow into said column and through said flow passages, (d) means for jigging the aqueous pulp in said column to form a low density bed of low density particles in said low density bed zone and to form a high density bed of high density particles in said high density bed zone, (e) means for discharging a tail fraction containing low density particles of the aqueous pulp from the upper portion of said column above said low density bed zone, (f) means for discharging a concentrate fraction containing high density particles of aqueous pulp from the lower portion of said column below said high density bed zone.

2. A device according to claim 1 wherein said packing means comprises a plurality of vertically extending plates; and spacer means for laterally spacing said plates apart to define a plurality of flow passages between adjacent plates.

3. A device according to claim 2 including a plurality of vertically adjacent, separate sections of said plates.

4. A device according to claim 3 wherein said sections are oriented so that the vertical plants of the plates in each of said sections are angularly related to the vertical planes of the plates in the adjacent section, and wherein said spacer means comprises rows of corrugations on each of said plates extending diagonally relative to the horizontal.

5. A device according to claim 4 wherein the corrugations of adjacent plates extend in opposite directions.

6. A device for gravitational separation of particles having differences in density, said particles being initially in admixture in an aqueous pulp, said admixture comprising two or more types of particles ranging from relatively low density particles to relatively high density particles, said device comprising:

(a) a tubular column having an upper portion including a low density bed zone, a lower portion including a high density bed zone, and an intermediate portion including a pulp inlet zone between said upper portion and lower portion, each of said beds containing a packing material defining a large number of small passages and interconnected chambers extending in a circuitous pattern through the respective zones, (b) means for forming a dispersion of aqueous pulp, (c) means for feeding the dispersion of aqueous pulp into said pulp inlet zone for flow into said column and through said flow passages, (d) means for jigging the aqueous pulp in said column to form a low density bed of low density particles in said low density bed zone and to form a high density bed of high density particles in said high density bed zone, (e) means for discharging a tail fraction containing low density particles of the aqueous pulp from the upper portion of said column above said low density bed zone, (f) means for discharging a concentrate fraction containing high density particles of aqueous pulp from the lower portion of said column below said high density bed zone, wherein said device comprises means for prescreening said aqueous pulp prior to said inlet, said prescreening means removing large particles from said aqueous pulp to produce an aqueous pulp having an admixture of particles consisting of particles having a size of less than 150 mesh.

7. A device for gravitational separation of particles having differences in density, said particles being initially in admixture in an aqueous pulp, said admixture comprising two or more types of particles ranging from relatively low density particles to relatively high density particles, said device comprising:

(a) a tubular column having an upper portion including a low density bed zone, a lower portion including a high density bed zone, and an intermediate portion including a pulp inlet zone between said upper portion and lower portion, each of said beds containing a packing material defining a large number of small passages and interconnected chambers extending in a circuitous pattern through the respective zones, (b) means for forming a dispersion of aqueous pulp, (c) means for feeding the dispersion of aqueous pulp into said pulp inlet zone for flow into said column and through said flow passages, (d) means for jigging the aqueous pulp in said column to form a low density bed of low density particles in said low density bed zone and to form a high density bed of high density particles in said high density bed zone, (e) means for discharging a tail fraction containing low density particles of the aqueous pulp from the upper portion of said column above said low density bed zone, (f) means for discharging a concentrate fraction containing high density particles of aqueous pulp from the lower portion of said column below said high density bed zone, wherein said device comprises means for producing an aqueous pulp having an admixture of particles comprising at least 99 percent by weight particles having sizes of less than 150 microns based on the total weight of particles in said pulp.

8. A device for gravitational separation of particles having differences in density, said particles being initially in admixture in an aqueous pulp, said admixture comprising two or more types of particles ranging from relatively low density particles to relatively high density particles, said device comprising:

(a) a tubular column having an upper portion including a low density bed zone, a lower portion including a high density bed zone, and an intermediate portion including a pulp inlet zone between said upper portion and lower portion, each of said beds containing a packing material defining a large number of small passages and interconnected chambers extending in a circuitous pattern through the respective zones, (b) means for forming a dispersion of aqueous pulp, (c) means for feeding the dispersion of aqueous pulp into said pulp inlet zone for flow into said column and through said flow passages, (d) means for jigging the aqueous pulp in said column to form a low density bed of low density particles in said low density bed zone and to form a high density bed of high density particles in said high density bed zone, (e) means for discharging a tail fraction containing low density particles of the aqueous pulp from the upper portion of said column above said low density bed zone, (f) means for discharging a concentrate fraction containing high density particles of aqueous pulp from the lower portion of said column below said high density bed zone, wherein said device comprises means for producing an aqueous pulp wherein the admixture consists of particles having sizes of less than 150 microns.

9. A device for gravitational separation of particles having differences in density, said particles being initially in admixture in an aqueous pulp, said admixture comprising two or more types of particles ranging from relatively low density particles to relatively high density particles, said device comprising:

(a) a tubular column having an upper portion including a low density bed zone, a lower portion including a high density bed zone, and an intermediate portion including a pulp inlet zone between said upper portion and lower portion, each of said beds containing a packing material defining a large number of small passages and interconnected chambers extending in a circuitous pattern through the respective zones, (b) means for forming a dispersion of aqueous pulp, (c) means for feeding the dispersion of aqueous pulp into said pulp inlet zone for flow into said column and through said flow passages, (d) means for jigging the aqueous pulp in said column to form a low density bed of low density particles in said low density bed zone and to form a high density bed of high density particles in said high density bed zone, (e) means for discharging a tail fraction containing low density particles of the aqueous pulp from the upper portion of said column above said low density bed zone, (f) means for discharging a concentrate fraction containing high density particles of aqueous pulp from the lower portion of said column below said high density bed zone, wherein said jigging means comprises a pulsating water pump and a water inlet located below said lower portion for sending pulses of water into said high density bed sufficient to cause a jigging of said beds and gravity separation of said high density and low density particles.

10. A process for gravitation separation of relatively high and low density particles initially in admixture in an aqueous pulp, said process comprising:

(a) providing a tubular column having an upper portion including a low density bed zone, a lower portion including a high density bed zone, and an intermediate portion including a pulp inlet zone between said upper portion and lower portion;

(b) providing in said upper zone and said lower zone a packing material defining a large number of flow passages extending in a circuitous pattern through the respective zone;

(c) introducing the pulp into the pulp inlet zone for flow through the flow passages of the packing materials to form a low density bed of particles in said upper zone and a high density bed of particles in said lower zone, (d) jigging the particles in said beds to cause gravitational separation of said high and low density particles in said pulp by causing migration of the low density particles toward and into said low density bed and causing migration of said high density particles toward and into said high density bed;

(e) withdrawing a tailing fraction containing low density particles from the upper portion of said column above the upper zone, and (f) withdrawing a concentrate fraction containing high density particles from the lower portion of the column below the lower zone.

11. A process according to claim 10 wherein the pulp contains a mineral ore including a mixture of mineral value particles and gangue particles, the pulp is prepared for gravity separation by treating said particles with a dispersant which is effective to reduce agglomeration of the particles in at least one of said beds.

12. A process according to claim 11 wherein said mineral ore is an iron ore.

13. A process according to claim 10 wherein the packing comprises a plurality of separate, vertically adjacent sections of vertically extending plates; and spacer means for laterally spacing said plates apart to define a plurality of flow passages and chambers.

14. A process according to claim 13 wherein said sections are oriented so that the vertical planes of the plates in one section is angularly related to the vertical planes of the plates in the adjacent section, and wherein the spacer means comprises rows of corrugations on each of the plates extending diagonally relative to the horizontal.

15. A process according to claim 14 wherein the corrugation of adjacent plates extend in opposite directions.

16. A process for gravitation separation of relatively high and low density particles initially in admixture in an aqueous pulp, said process comprising:

(a) providing a tubular column having an upper portion including a low density bed zone, a lower portion including a high density bed zone, a water inlet located below said lower portion, and an intermediate portion including a pulp inlet zone between said upper portion and lower portion;

(b) providing in said upper zone and said lower zone a packing material defining a large number of flow passages extending in a circuitous pattern through the respective zone;

(c) introducing the pulp into the pulp inlet zone for flow through the flow passages of the packing materials to form a low density bed of particles in said upper zone and a high density bed of particles in said lower zone, introducing water through said water inlet into said lower portion of the column, (d) jigging the particles in said beds to cause gravitational separation of said high and low density particles in said pulp by causing migration of the low density particles toward and into said low density bed and causing migration of said high density particles toward and into said high density bed;

(e) withdrawing a tailing fraction containing low density particles from the upper portion of said column above the upper zone, and (f) withdrawing a concentrate fraction containing high density particles from the lower portion of the column below the lower zone, wherein said jigging comprising sending pulses of water into and upward through said beds.

17. The process of claim 16 wherein the admixture particles of said pulp consists of parts having particle sizes of less than 100 microns.

18. The process of claim 16 wherein the admixture of particles of said pulp comprise at least 99 percent by weight particles having sizes of less than 150 mesh.

19. The process of claim 16 comprising means for removing particles having a mesh size of greater than 150 mesh from said pulp prior to said inlet.

20. A process for gravitation separation of relatively high and low density particles initially in admixture in an aqueous pulp, said process consisting of:

(a) providing a tubular column having an upper portion including a low density bed zone, a water inlet located below said lower portion, a lower portion including a high density bed zone, and an intermediate portion including a pulp inlet zone between said upper portion and lower portion;

(b) providing in said column a means for defining a large number of passages through said column;

(c) introducing the pulp into the pulp inlet zone for flow through the flow passages to form a low density bed of particles in said upper zone and a high density bed of particles in said lower zone, introducing water through said water inlet into said lower portion of the column, (d) jigging said particles in said beds to cause gravitational separation of said high and low density particles in said pulp by causing migration of the low density particles toward and into said low density bed and causing migration of said high density particles toward and into said high density bed;

(e) withdrawing a concentrate fraction containing low density particles from the upper portion of said column above the upper zone, and (f) withdrawing a tailing fraction containing high density particles from the lower portion of the column below the lower zone.

* * * * *

UNITED STATES PATENT AND TRADEMARK OFFICE

CERTIFICATE OF CORRECTION

PATENT NO. : 5,507,393

DATED : April 16, 1996

INVENTOR(S) : David C. Yang

It is certified that error appears in the above-indentified patent and that said Letters Patent is hereby corrected as shown below:

Column 9, line 40 delete "process over the comparative plant data utilizing a conven-"
Column 9, line 41 delete "tional process"
Column 9, line 46 after "separator" begin a new paragraph with "Coal"
Column 9, line 66 after "Final" insert --Tails--
Column 10, line 4 delete "Tails"

Signed and Sealed this

Sixth Day of August, 1996

*Attest:*

Bruce Lehman

BRUCE LEHMAN

*Attesting Officer*

*Commissioner of Patents and Trademarks*